US008955709B2

(12) United States Patent
Lorenz et al.

(10) Patent No.: US 8,955,709 B2
(45) Date of Patent: Feb. 17, 2015

(54) LARGE CARGO CARRIER

(75) Inventors: Reinhard Lorenz, Uelsen (DE); Jan Abraham Huizingh, Vlagtwedde (NL)

(73) Assignee: Schoeller Arca Systems GmbH, Schwerin (DE)

( * ) Notice: Subject to any disclaimer, the term of this patent is extended or adjusted under 35 U.S.C. 154(b) by 0 days.

(21) Appl. No.: 13/639,996

(22) PCT Filed: May 21, 2010

(86) PCT No.: PCT/EP2010/003143

§ 371 (c)(1),
(2), (4) Date: Oct. 8, 2012

(87) PCT Pub. No.: WO2011/124239

PCT Pub. Date: Oct. 13, 2011

(65) Prior Publication Data

US 2013/0048522 A1 Feb. 28, 2013

(30) Foreign Application Priority Data

Apr. 9, 2010 (DE) ..... 10 2010 014 349

(51) Int. Cl.
*B65D 6/24* (2006.01)
*B65D 6/16* (2006.01)
(Continued)

(52) U.S. Cl.
CPC ..... *B65D 21/083* (2013.01); *B65D 19/18* (2013.01); *B65D 2519/00034* (2013.01); *B65D 2519/00069* (2013.01); *B65D 2519/00174* (2013.01); *B65D 2519/00268* (2013.01); *B65D 2519/00288* (2013.01); *B65D 2519/00318* (2013.01);
(Continued)

(58) Field of Classification Search
USPC ..... 220/666, 691, 621.7, 4.03, 6; 206/600; 217/12 R, 43 R, 43 A
See application file for complete search history.

(56) References Cited

U.S. PATENT DOCUMENTS 3,591,212 A * 7/1971 Rhyne ..... 217/65
4,591,065 A * 5/1986 Foy ..... 220/7
(Continued)

FOREIGN PATENT DOCUMENTS

CN 2765865 3/2006
DE 6930505 U 1/1970
(Continued)

OTHER PUBLICATIONS

International Search Report and Written Opinion for PCT/EP2010/003143.
(Continued)

*Primary Examiner* — Fenn Mathew
*Assistant Examiner* — Jennifer Castriotta
(74) *Attorney, Agent, or Firm* — Gerald E. Helget; Briggs and Morgan, P.A.

(57) ABSTRACT

The invention relates to a large load carrier (1) including a pallet-shaped base element (2) and at least one detachably fastened side wall (5*a*, 5*b*). According to the invention, the large cargo carrier includes at least one pedestal element (4*a*, 4*b*), which is configured so that the pedestal element is detachably fastened at the pallet-shaped base element and is detachably fastened at the at least one side wall. The invention further relates to a kit for constructing such a large cargo carrier.

7 Claims, 9 Drawing Sheets

(51) Int. Cl.

| | |
|---|---|
| ***B65D 90/08*** | (2006.01) |
| ***B65D 19/06*** | (2006.01) |
| ***B65D 21/08*** | (2006.01) |
| ***B65D 19/18*** | (2006.01) |

(52) U.S. Cl.

CPC ..... *B65D2519/00348* (2013.01); *B65D 2519/00502* (2013.01); *B65D 2519/00587* (2013.01); *B65D 2519/00641* (2013.01); *B65D 2519/00646* (2013.01); *B65D 2519/009* (2013.01); *B65D 2519/0099* (2013.01); *B65D 2519/00995* (2013.01)

USPC ..... 220/621; 220/666; 220/691; 220/4.03; 206/600; 217/12 R; 217/43 A

(56) References Cited

U.S. PATENT DOCUMENTS

| | | | | |
|---|---|---|---|---|
| 4,723,679 | A * | 2/1988 | Sinchok et al. | 220/4.03 |
| 4,998,967 | A * | 3/1991 | Box | 119/489 |
| 5,114,037 | A * | 5/1992 | Hillis et al. | 220/4.03 |
| 5,199,589 | A * | 4/1993 | Noble | 220/7 |
| 5,632,392 | A * | 5/1997 | Oh | 220/7 |
| 5,788,103 | A | 8/1998 | Wagner et al. | |
| 5,865,334 | A * | 2/1999 | Ruiz et al. | 220/6 |
| 7,353,962 | B2 * | 4/2008 | Parnall et al. | 220/6 |
| 2002/0108950 | A1 * | 8/2002 | Moorman et al. | 220/7 |

FOREIGN PATENT DOCUMENTS

| | | | |
|---|---|---|---|
| DE | 102004012198 | | 9/2005 |
| DE | 102004012198 | A1 | 9/2005 |
| EP | 1264774 | A1 | 12/2002 |
| GB | 2416762 | | 2/2006 |
| WO | 2005097611 | A1 | 10/2005 |

OTHER PUBLICATIONS

Chinese Office Action for Application No. 201080066576.8 issued May 28, 2014.

* cited by examiner

LARGE CARGO CARRIER

BACKGROUND OF THE INVENTION

The invention relates to a large cargo carrier for transporting and storing goods according to the preamble of patent claim 1.

Large cargo carriers of this type include a pallet shaped base element which for example has the dimensions of Europol industrial pallets, also designated Euro pallets. Standard dimensions for the plan forms of such large cargo carriers are for example 800×600 mm, 1200×800 mm, 1200×1000 mm, and 1200×1600 mm. These dimensions form an optimum geometry for transportation in a truck or TEU standard container with respect to logistics and space utilization.

The height of such large cargo carriers computed from the contact surface of the large cargo carrier on the ground up to the upper edge of the sidewalls is typically 750 mm, 850 mm, 975 mm or 1000 mm, wherein these dimensions do not represent any limitations.

Thus, for the known large cargo carriers, there is a fixed determination to a height that is predetermined by the dimensions of the plate shaped base element in combination with the side walls. From DE 10 2004 012 198 A1, it is also known to arrange a removable transport frame which includes four circumferential sidewalls. Thus, the transport frame as a whole can be disengaged from the base element and replaced as required. It is a disadvantage that this is associated with substantial complexity.

SUMMARY OF THE INVENTION

Thus it is an object of the invention to provide a large cargo carrier which can be configured for different heights in a simple manner.

The object is achieved by a large cargo carrier with the features of the characterizing portion of claim 1 and by a kit with the features of claim 8, wherein advantageous embodiments are characterized by the features of the dependent claims.

The large cargo carrier according to the invention is characterized by at least one pedestal element, preferably, however, four circumferentially arranged pedestal elements which are respectively configured so that they are disengageably attached at the plate shaped base element or an edge bar that is arranged thereon, in particular integrally configured therewith and protrude in upward direction beyond the pallet support surface and wherein at least one sidewall is disengageably attached at the pallet shaped base element.

Through pedestal elements with different heights, a height increase of the large cargo carrier for particular heights is possible with otherwise identical components, wherein the height increase is for example 10 cm, 20 cm, 25 cm, etc. Thus, particular heights of a side of a large cargo carrier of for example 750 mm, 870 mm, 975 mm and 1000 mm or even higher can be achieved, wherein these dimensions do not limit the scope of the invention. Thus, an additional time-, cost-, and development-complexity for producing large cargo carriers with different heights can be avoided.

Thus particularly preferably the sidewall is configured so that it is directly attachable in a disengageable manner at the pallet shaped base element or the edge bar attached thereto and the sidewall is also attachable in a disengageable manner at the pedestal element. Through the flexible connection of the sidewall with the base element, namely directly or elevated through the pedestal element, this yields a decisive advantage in that various heights are achievable in a simple manner.

The upper edges of the sidewalls arranged on the attachment frame are thus preferably joined flush so that a height of the large cargo carrier is achieved that is even over the sidewalls. Four circumferentially arranged pedestal elements thus form an attachment frame or pedestal frame. Through the attachment frame, the large cargo carrier is adaptable through pedestal elements with different heights and otherwise constant components to heights of for example 750 mm, 870 mm, 975 mm, and 1000 mm, wherein these dimensions do not limit the scope of the invention, and the large cargo carrier is advantageously stackable together with typical wood pallet carriers in a cargo bay of a truck when standard dimensions are used.

The large cargo carrier can include a circumferential edge bar or also plural edge bars which extend respectively over a side of the large cargo carrier which can be adjacent to one another in the corner portions of the large cargo carrier.

The edge bars are thus preferably configured with different heights wherein, however, two edge bars that are respectively configured with identical heights and/or two edge bars adjoining one another in a corner are configured with different heights. For sidewalls that are supported so that they are foldable, this advantageously yields a folding sequence, wherein the sidewalls which are associated with the lower edge bars are folded in first and the sidewalls which are attached at the higher edge bars are folded over them.

Two pedestal elements that are respectively adjacent to one another are attachable at one another in a disengageable manner preferably through a plug-in mechanism that acts in a direction parallel to the base or base element and which is preferably provided on both sides laterally at the base element. The plug-in mechanism thus provides a form locking connection between the pedestal elements, wherein an additional attachment safety can be achieved through threaded connections or similar through plug-in grooves and plug-in pinions configured complementary thereto. The plug-in mechanism thus facilitates a quasi puzzle shaped joining of the pedestal elements into a circumferential attachment frame.

Thus the plug-in mechanism preferably includes a dove tail structure with approximately trapezoid attachment grooves and respective attachment pinions, whereas also three connections or triangular or circular or circular segment structures are feasible, wherein, however, form locking surfaces that are at a slant angle are preferred, wherein the form locking surfaces are characterized by particularly high strength with respect to transversal or tension forces when the pedestal elements move relative to one another.

For four circumferential pedestal elements, preferably two respective opposite pedestal elements are configured identical and/or two pedestal elements that are adjacent to one another are configured different in order to facilitate assembly. Thus, the pedestal elements can join one another and be attachable at one another in the corner portion or in the lateral portion of the large cargo carrier.

According to one embodiment, preferably the two pedestal elements that are opposite one another and which are associated with the shorter side of the large cargo carrier have U-shape, this means they are configured U-shaped with a base which extends over a shorter side of the large cargo carrier and corner portions that are adjacent thereto and they are configured with legs that extend in a shortened manner over portions of the adjacent longer sides of the large cargo carrier. The two pedestal elements that are associated with the longer sides and arranged opposite to one another respectively extend over the remaining intermediary portion of the longer side of the large cargo carrier which has a size approximately between half the length of the longer side and four-fifths of the length of the longer side.

Accordingly, preferably two of the four pedestal elements are run on both sides over the corners of the large cargo carrier and only join the two other pedestal elements in the side portions. Thus, embodiments are facilitated in which only two pedestal elements are being used that are arranged adjacent to one another which yields for example the advantage that the large cargo carrier can also be configured with side windows or reach-in openings. Through the support over the corners, the U-shaped base elements contact three edge bars that are adjacent to one another in a stable manner, so that a stacking of additional large cargo carriers on the large cargo carrier is facilitated.

It is an additional advantage that this facilitates a particularly simple assembly of the pedestal frame on the large cargo carrier. According to a preferred embodiment, the pedestal elements that are configured U-shaped include support grooves and are placed onto the edge bars first. Thus the pedestal elements are supported by the support on three sides in a stable manner. The two other pedestal elements can thus be easily inserted through the plug in mechanism.

The pedestal elements are attachable at one another in a disengageable manner at the edge bars or at the base element of the large cargo carrier preferably through an exertion mechanism through form locking, wherein the attachment can be reinforced through bolted connections or similar. The plug in mechanism advantageously includes a structure with trapezoid plug in grooves and trapezoid plug in pinions, for example configured as a dove tail connection.

Thus, it is particularly preferred when the pedestal element is secured against lifting from above through protruding shoulders at the plug in grooves, wherein the plug in mechanism of the pedestal element reaches behind the plug in mechanism.

In the plug in grooves, furthermore in all embodiments certainly hinge bolt receivers and hinge bolts can be arranged in the plug in pinions so that the pedestal elements and/or the sidewalls are supported foldable.

In one embodiment of the invention, it is also advantageous to configure the pedestal elements compatible with one another so that it is possible to attach plural pedestal elements above one another and at one another and to eventually close them through circumferential sidewalls. The attachment frame or pedestal frame formed by four circumferential pedestal elements is thus arrangeable between the frame formed by the sidewalls that are attached at one another and the frame formed by the edge bars of the base element or also arrangeable on the top side or on the bottom side at a second attachment frame formed by the base elements.

In another aspect of the invention, a kit for a large cargo carrier includes a pallet shaped base element and at least one sidewall that is attachable in a disengageable manner and a pedestal element which is configured so that it is disengageably attached at the pallet shaped base element or at an edge bar that is arranged at the base element, in particularly integrally configured therewith and protruding upward beyond the pallet support surface and wherein the at least one sidewall is disengageably attachable at the pedestal element wherein the large cargo carrier is adaptable to different heights of preferably 750 mm, 870 mm, 975 mm, and 1000 mm.

The kit can be assembled in a few manual steps to form a large cargo carrier and can be disassembled in a few manual steps into the particular components without damages to the particular components being caused. Thus it is important that assembling or disassembling can be done as often as possible. This is facilitated in that, preferably, components are used for the kit which are configured as described supra so that a large cargo carrier as described supra can be produced from the kit. Thus the kit can be sold in volume saving packaged units which is an advantage over assembled large cargo carriers.

The pedestal elements are preferably provided in different heights that are adjusted to one another so that the height of the large cargo carrier is adjustable in increments through respective placement of the pedestal elements; this means that the large cargo carrier is adaptable to the different heights in a simple manner.

BRIEF DESCRIPTION OF THE DRAWING

Additional advantages and embodiments of the invention are described with reference to drawing figures, wherein elements with like configuration or function are designated with identical reference numerals, wherein.

DETAILED SPECIFICATION

Figure 1:
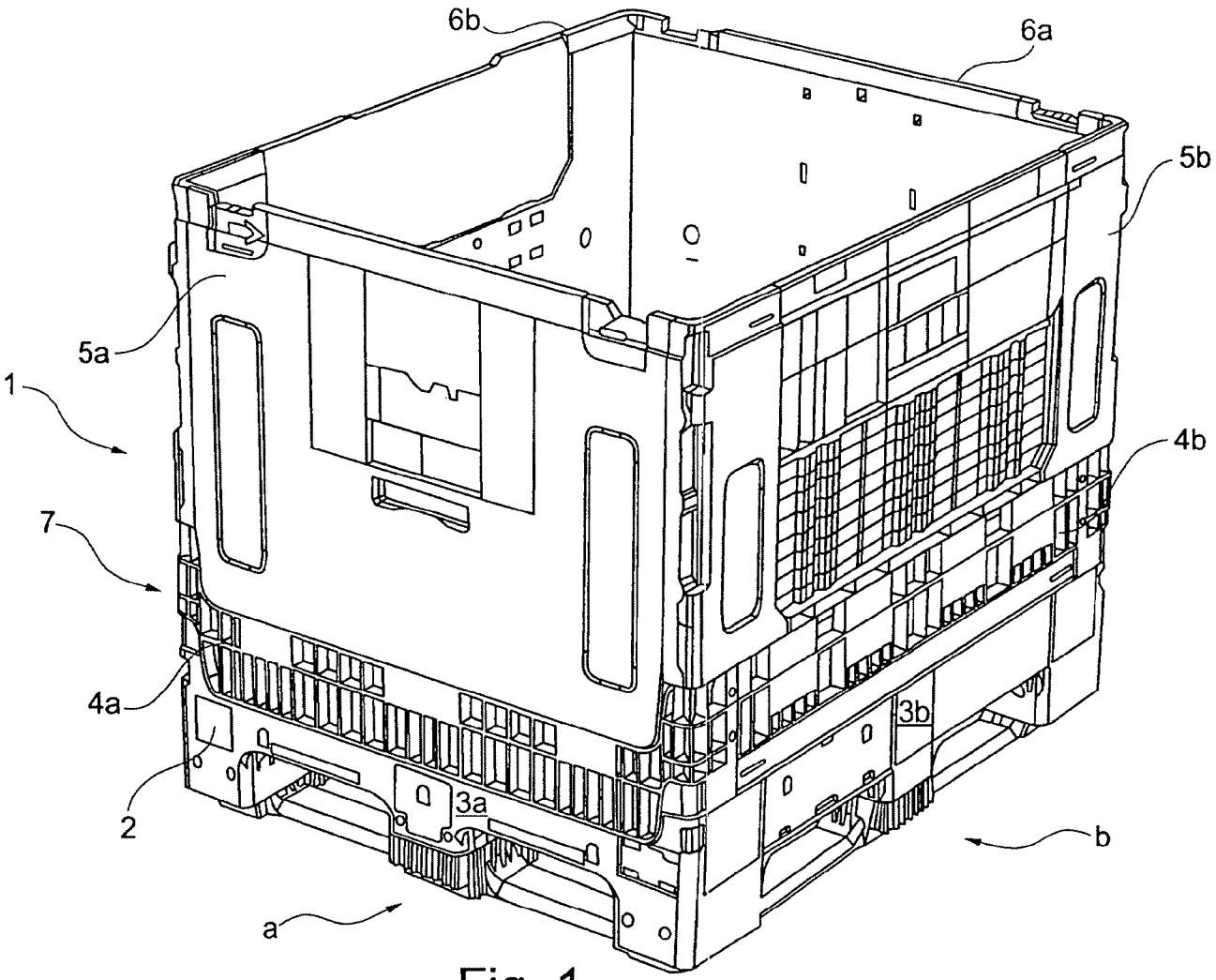
FIG. 1 illustrates a perspective view of a large cargo carrier with an attachment frame and circumferential sidewalls.

FIG. 1 illustrates a large cargo carrier 1 with a pallet shaped base 2 with first and second edge bars 3*a*, 3*b* and furthermore first and second pedestal elements 4*a*, 4*b* and circumferential sidewalls 5*a*, 5*b* arranged thereon. The respective edge bars 3*a*, 3*b* that are respectively joining one another are configured with different heights for foldable support of the sidewalls 5*a*, 5*b*. The respective sidewalls 5*a*, 5*b* that join one another are also configured with different heights so that they adjoin one another flush in the interconnection with the edge bars 3*a*, 3*b* that are configured with different heights and the pedestal elements 4*a*, 4*b* arranged at their upper edges 6*a*, 6*b*, which, however, is not required mandatorily. It would also be possible to respectively configure the edge bars 3*a*, 3*b*, the pedestal elements 4*a*, 4*b* and the sidewalls 5*a*, 5*b* with identical heights.

The four circumferentially arranged and laterally adjoining pedestal elements 4*a*, 4*b* jointly form an attachment frame 7. It is apparent from FIG. 1 that a height increase of the large cargo carrier for particular standard heights is feasible through pedestal elements 4*a*, 4*b* with different heights, whereas the other components are identical, wherein the standard height increase can be for example 10 cm, 20 cm, 25 cm, etc. Thus particular heights for the large cargo carrier of for example 750 mm, 870 mm, 975 mm and 1000 mm or higher can be achieved.

Figure 2:
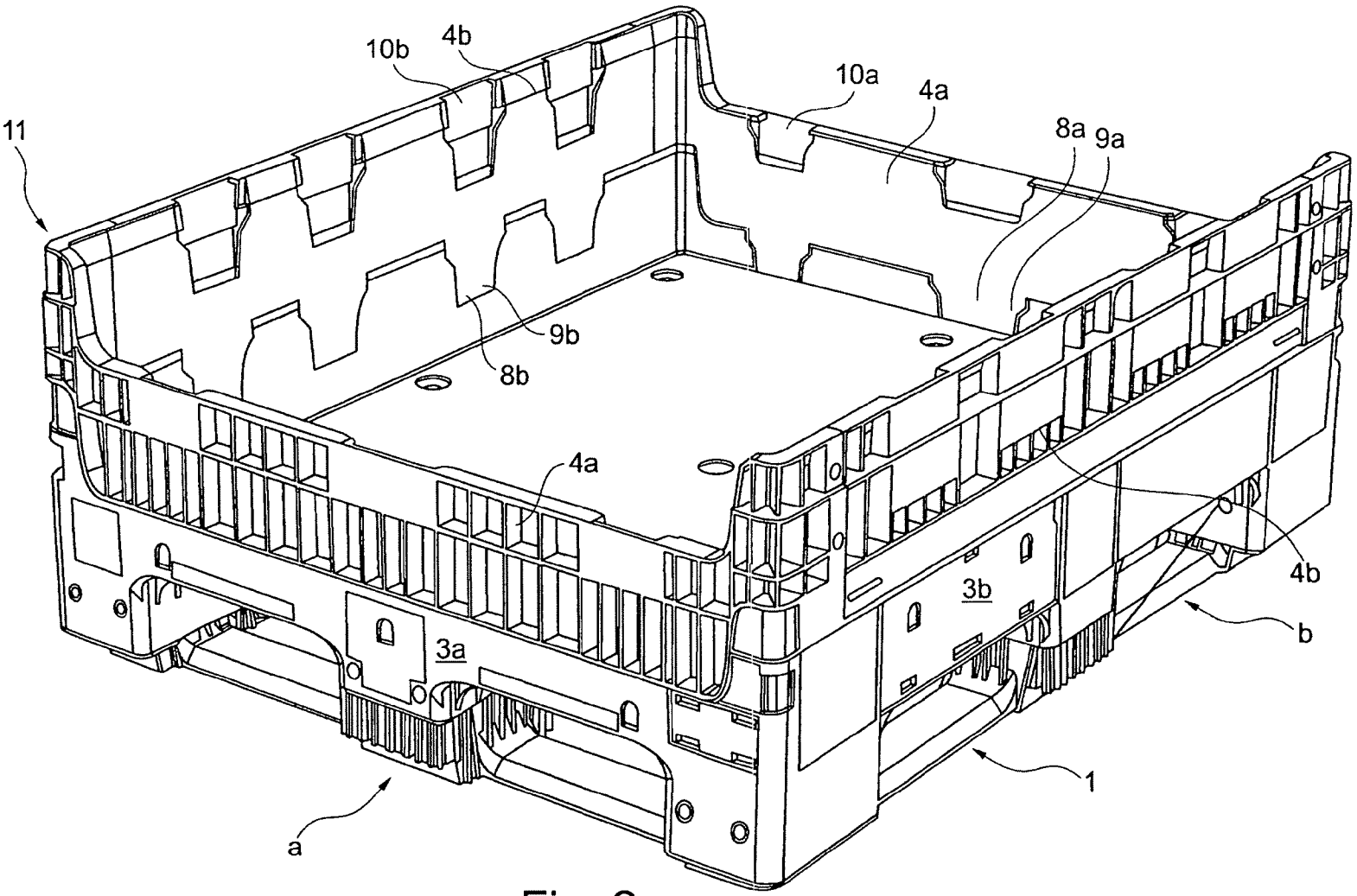
FIG. 2 illustrates a perspective view of a large cargo carrier with four circumferentially arranged pedestal elements.

FIG. 2 illustrates the large cargo carrier 1 of FIG. 1, wherein the sidewalls 5*a*, 5*b* are not illustrated for purposes of clarity. The first sidewalls 3*a* extend over the shorter side a of the approximately rectangular pallet shaped base 2 and the second edge bars 3*b* extend over the longer side b of the pallet shaped base 2. Corresponding to the edge bars 3*a*, 3*b*, the two first pedestal elements 4*a* and two second pedestal elements 4*b* are respectively arranged opposite one another.

The first and second pedestal elements 4*a*, *b* respectively have an plug in mechanism at their bottom sides, wherein the plug in mechanism herein is configured for example with three to four plug in pinions 8*a*, 8*b* which are inserted into respective complementary plug in grooves 9*a*, 9*b* of the edge bars 3*a*, 3*b*. In this embodiment, the first pedestal elements 4*a* and the first edge bars 3*a* include first plug in pins 8*a* and first plug in grooves 9*a* which are configured differently from those of the second edge bars 3*b* and the second pedestal elements 4*b* which, however, is not mandatory.

The first and second pedestal elements 4*a*, 4*b* include another plug in mechanism on the top side which is configured as three or four plug in grooves 10*a*, 10*b* for receiving the plug in pinions of the sidewall which are not illustrated. The first and the second pedestal elements 4*a*, 4*b* extend respectively essentially over the entire width of the edge bars 3*a*, 3*b* and join approximately in the corner portion 11 of the pallet shaped base 2. As illustrated in particular in FIG. 3, according to a preferred embodiment, the plug in elements that are associated with the shorter side a are configured U-shaped in top view, wherein the base 12 of the U-shape extends over the entire width of the first edge bar 3*a* and forms a main element of the U-shape and the two legs 13 of the U-shape are configured shortened and reach by a certain amount beyond the edge bars 3*b*, so that the corners of the attachment frame 7 are thus formed through the first pedestal elements 4*a*. Also an inverse embodiment is possible when required. The U-base 12 includes the previously described plug-in mechanism 8*a*, which interacts with the edge bar 3*a*. The U-legs 13 respectively extend parallel to the edge bars 3*b* joining the edge bar 3*a* and associated with the longer side b.

At least over a portion, thus one-sixth to one-eighth of the length of the large cargo carrier 1, the upper edge of the edge bars 3*b* is configured as a rail 14 for adjusting the first pedestal elements 4*a* along the second edge bars 3*b*. Accordingly, the U-arms 13 of the pedestal elements 4*a* include support grooves 14*a* on their bottom sides, wherein the U-legs 13 contact the rails 14. The support grooves 14*a* are configured complementary with the rails 14, this means with U-shaped cross-section for reaching over the rails 14 and preferably defined on both sides of the rail 14 through skirts 15.

Figure 3:
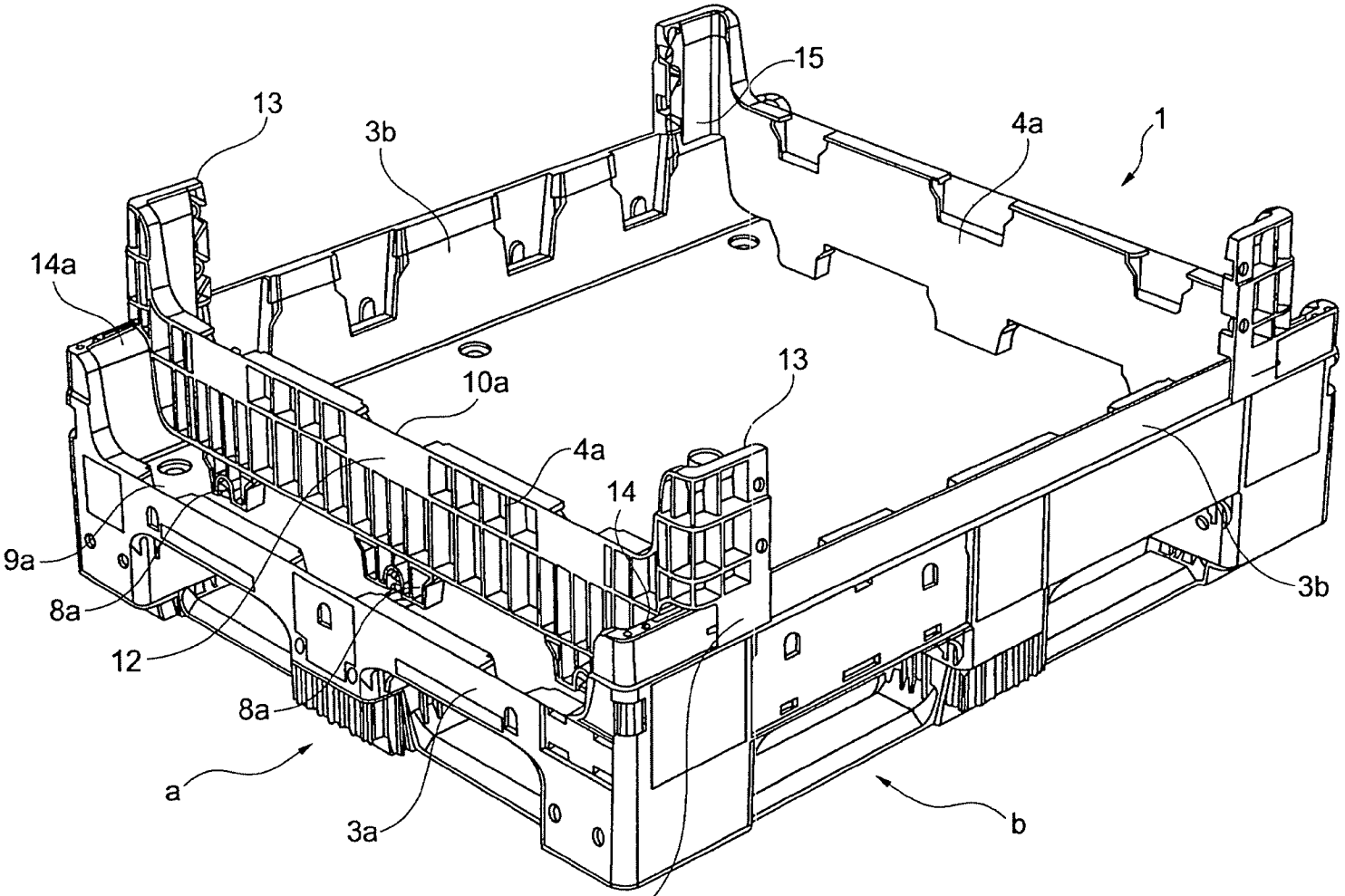
FIG. 3 illustrates a perspective view of a large cargo carrier with two first pedestal elements.
Figure 4:
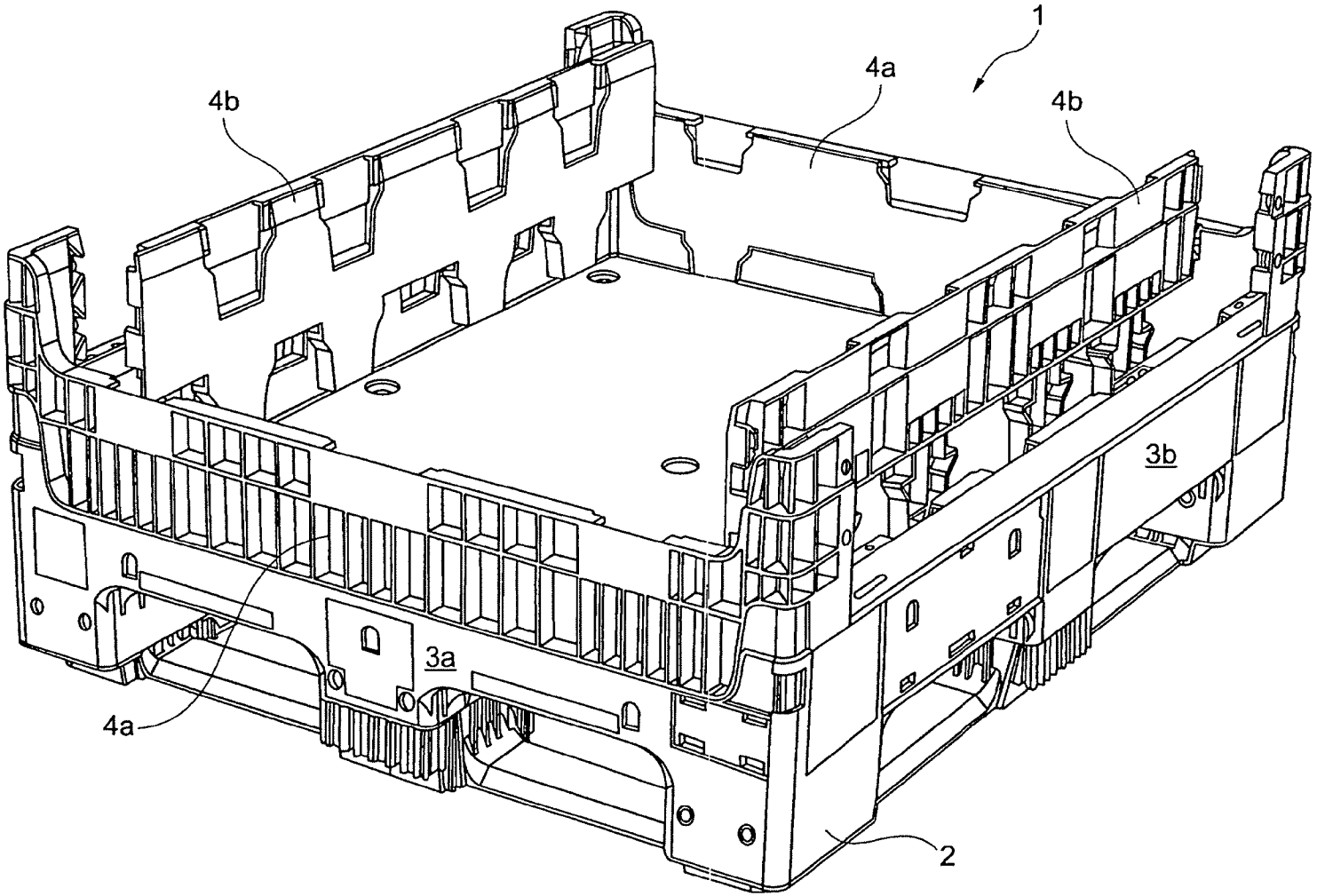
FIG. 4 illustrates a perspective view of a large cargo carrier with two first pedestal elements and two second pedestal elements in an exploded view.

In FIG. 4, the two second pedestal elements 4*b* are offset into the interior of the large cargo carrier 1 in an exploded view. Thus the method for mounting the attachment frame is clarified. Initially the first pedestal elements 4*a* as illustrated in FIG. 3 are arranged on the base element 2. Each pedestal element 4*a* is thus applied offset parallel from the edge bar 3*a* at which they are to be attached into the interior of the large cargo carrier 1. Thus the U-legs 13 contact the edge bars 3*b* when the pedestal element 4*a* is applied.

Subsequently, the first pedestal elements 4*a* are moved outward in a direction towards the first edge bars 3*a*, wherein the rails 14 slide in the support grooves 14*a*. Thus the skirts 15 support the guidance of the edge bar 3*b* on the rails 14. When the first pedestal elements 4*a* join the first edge bars 3*a*, the plug in protrusions or plug in pinions 8*a* interact with the plug in grooves 9*a*, so that the first pedestal elements 4*a* are displaceable in their entirety towards the edges of the large cargo carrier 1, this means they form a portion of the outer wall and terminate flush with the base element 2 or the first edge bar 3*a*.

Subsequently, as illustrated in FIG. 4, the second pedestal elements 4*b* which are provided for increasing the height of the second edge bar 3*b* are inserted into the remaining recesses. FIG. 2 illustrates the large cargo carrier 1 after inserting the attachment frame 7. It is clearly visible that the first and second pedestal elements 4*a*, 4*b* are respectively configured flush with the edge bars 3*a*, 3*b*. Subsequently, the method can be repeated with a second attachment frame or circumferential sidewalls 5*a*, 5*b* can be used.

Figure 5:
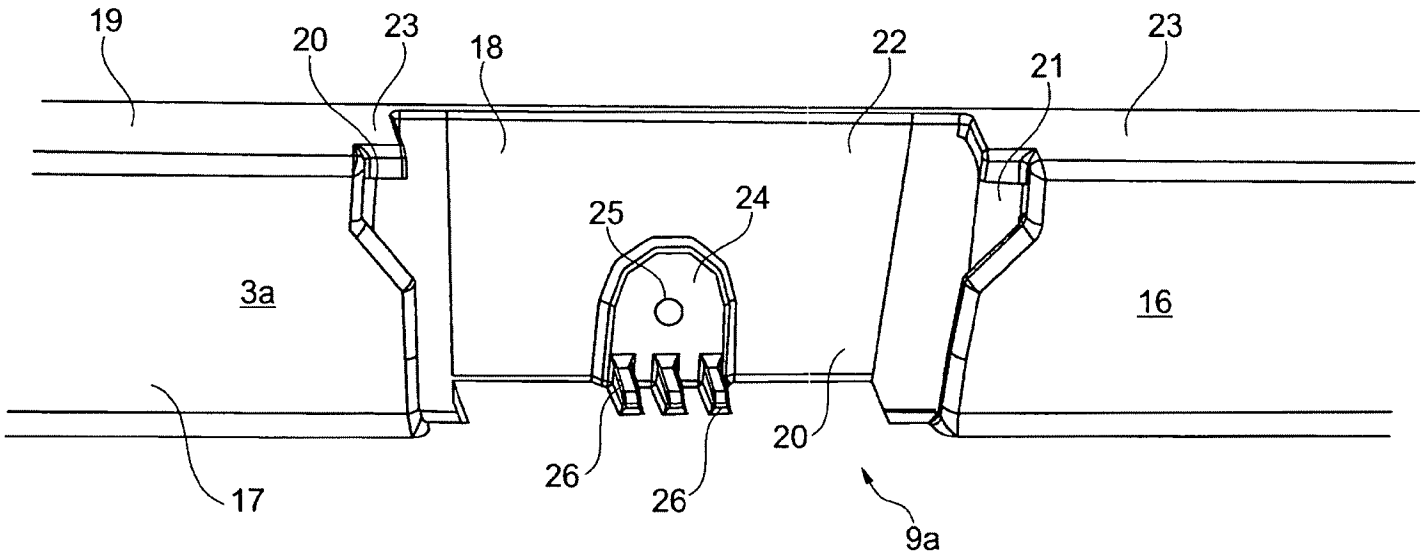
FIG. 5 illustrates a perspective view of an edge bar from an inside of the large cargo carrier.

FIG. 5 illustrates an inside 16 of the edge bar 3*a* with an plug in mechanism. The plug in mechanism is configured as a recessed portion configured as an plug in groove 9*a*. Thus the plug in groove 41 extends over the entire height of the edge bar 3*a* and in a transversal manner over a portion of plural centimeters.

The edge bar 3*a* is configured double walled, thus it includes an inner edge bar section 17 and an outer edge bar section 18 and an upper wall section 19. In the portion of the plug in groove 9*a*, the inner edge bar section 17 is completely recessed. The recess of the inner edge bar section 17 in this embodiment includes a substantially rectangular section 20 and wing portions 21 extending on both sides in outward direction over the rectangular section 20. Alternative embodiments are feasible herein, for example also a trapezoid shape which is well known as a classic dove tail mechanism.

Two shoulders 23 for contacting the wings of the pedestal element are configured in the upper wall section 19 in the portion of the wing sections 21, so that a lifting of the pedestal elements in upward direction is prevented. The upper wall section 19 thus corresponding to the rectangular section 20 of the inner edge bar section 17 also includes a substantially rectangular upper wall recess 22. In the portion of the wing sections 21 of the inner edge bar section 17, the upper wall recess 22 thus extends over approximately ¼ of the width of the upper wall section 19 and in the portion of the rectangular section 20 of the inner edge bar section 17, the upper wall recess 22 extends over more than ¾ of the width of the upper wall section 19, wherein a respective shoulder 23 is configured on both sides of the rectangular recess 20 of the inner edge bar section 17. The wings of the pedestal element reach behind the shoulders 23 after assembling the plug in mechanisms, which secures the shoulders against a lift-off in upward direction.

Furthermore, the plug in mechanism optionally includes a contact element 24 configured as an arch which is arranged on an inside of the large cargo carrier in the outer edge bar section 18 in the portion of the rectangular section 20 of the inner edge bar section 17 and which envelops a bolt hole 25. Another number or shape of positioning elements than the three ramps 26 arranged adjacent to one another in an exemplary manner and oriented into the interior of the large cargo carrier 1 can be provided.

Figure 6:
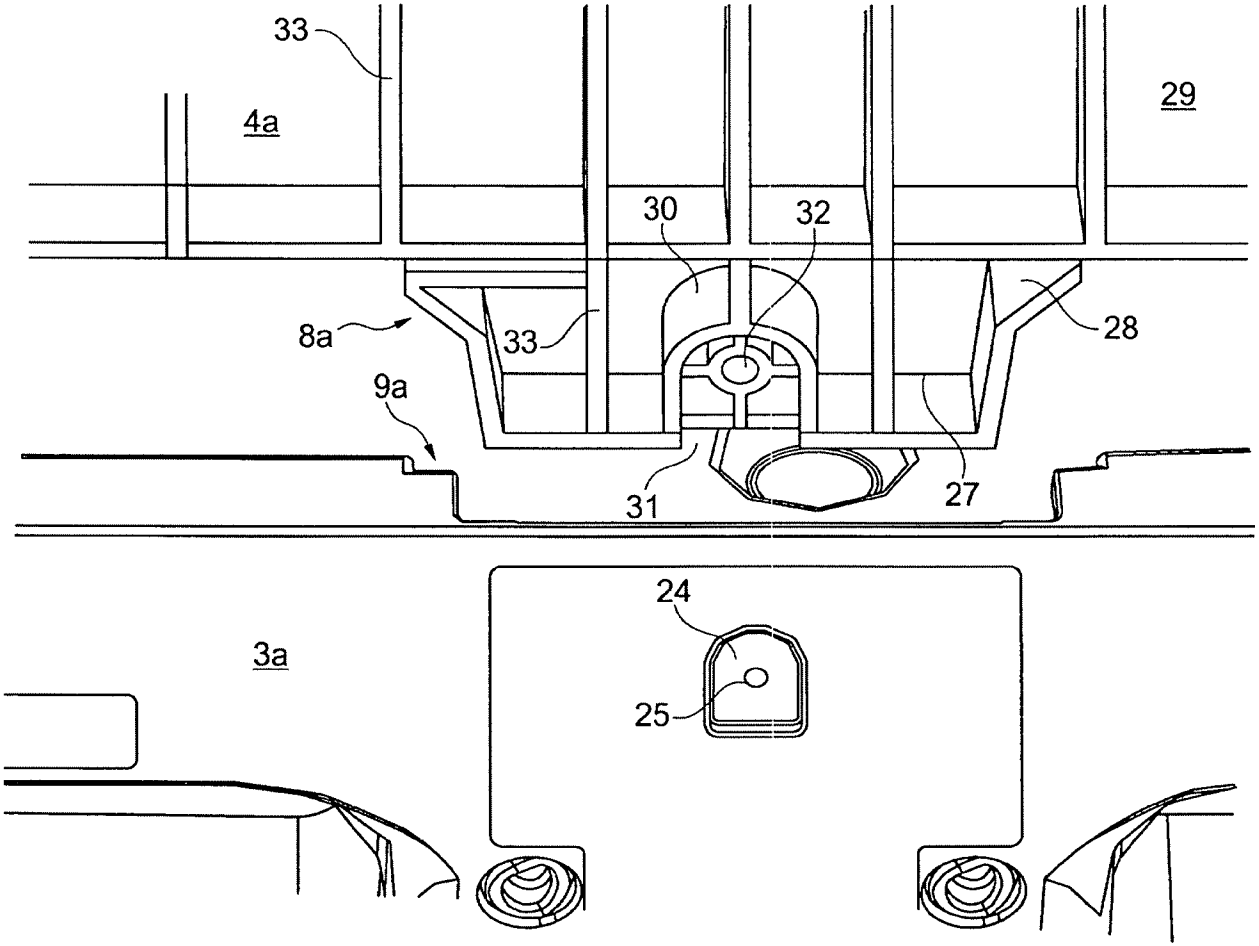
FIG. 6 illustrates a perspective view of an edge bar and a lower portion of a pedestal element from an outside of the large cargo carrier.

FIG. 6 illustrates the edge bar 3*a* illustrated in FIG. 5 from a perspective outside the large cargo carrier and furthermore a pedestal element 4*a* with an embodiment of an plug in mechanism of the pedestal element 4*a* that is configured complementary to the mechanism of the edge bar 3*a* described supra. The plug in mechanism thus includes a preferably rectangular section 27 with wings 28 arranged on both sides. Another arch 30 and a positioning recess 31 correspond to the contact element 24 and the positioning elements 26 in the edge bar 3*a* in the arch 30 that is configured open towards the bottom. The width of the positioning elements 26 is thus adjusted to the width of the positioning recess 31 so that a precise positioning of a bolt receiver 32 of the pedestal element 4*a* over the bolt hole 25 is provided when the pedestal element 4*a* approaches the edge bar 3*a* and a bolt can be subsequently inserted.

As apparent from FIGS. 2, 3 and 4, the plug in pins 8*a*, 8*b* on the side oriented towards an interior of the large cargo carrier are configured with one smooth and planar surface. On a side oriented towards an outside of the large cargo carrier, the plug in pins 8*a*, 8*b* like the outer walls 29 also include rib shaped structures 33 according to this embodiment. The outer walls 29 and the plug in pins 8*a*, 8*b* can also be configured smooth on the outside in other embodiments and vice versa. Additional rib shaped structures can be provided as required.

Figure 7:
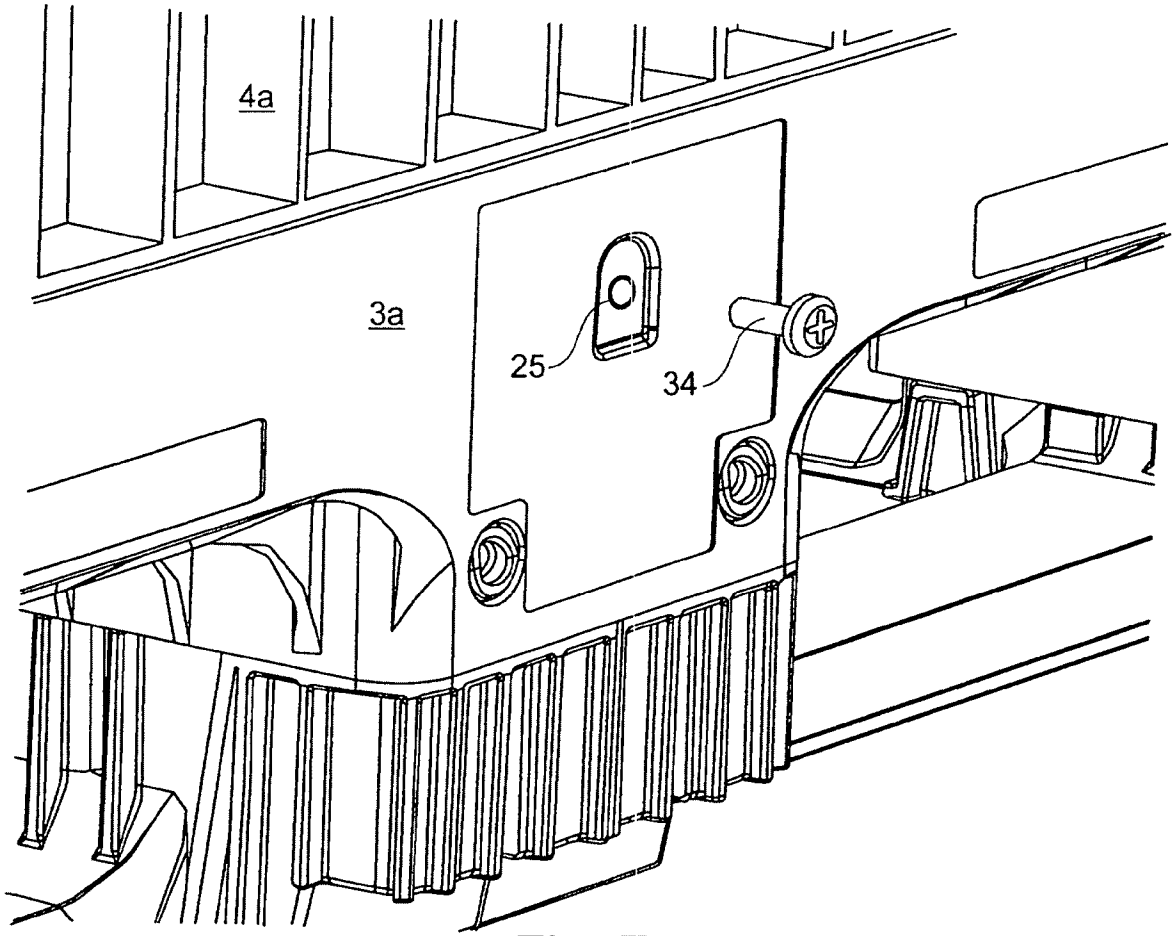
FIG. 7 illustrates a perspective view of a threaded connection at an outside of an edge bar.

FIG. 7 illustrates an additional attachment of the pedestal elements 4*a* at the edge bar 3*a* through a bolt 34 inserted from the outside into the pass through opening 25 in an exploded view that goes beyond the form locking engagement of the plug in mechanism.

Figure 8:
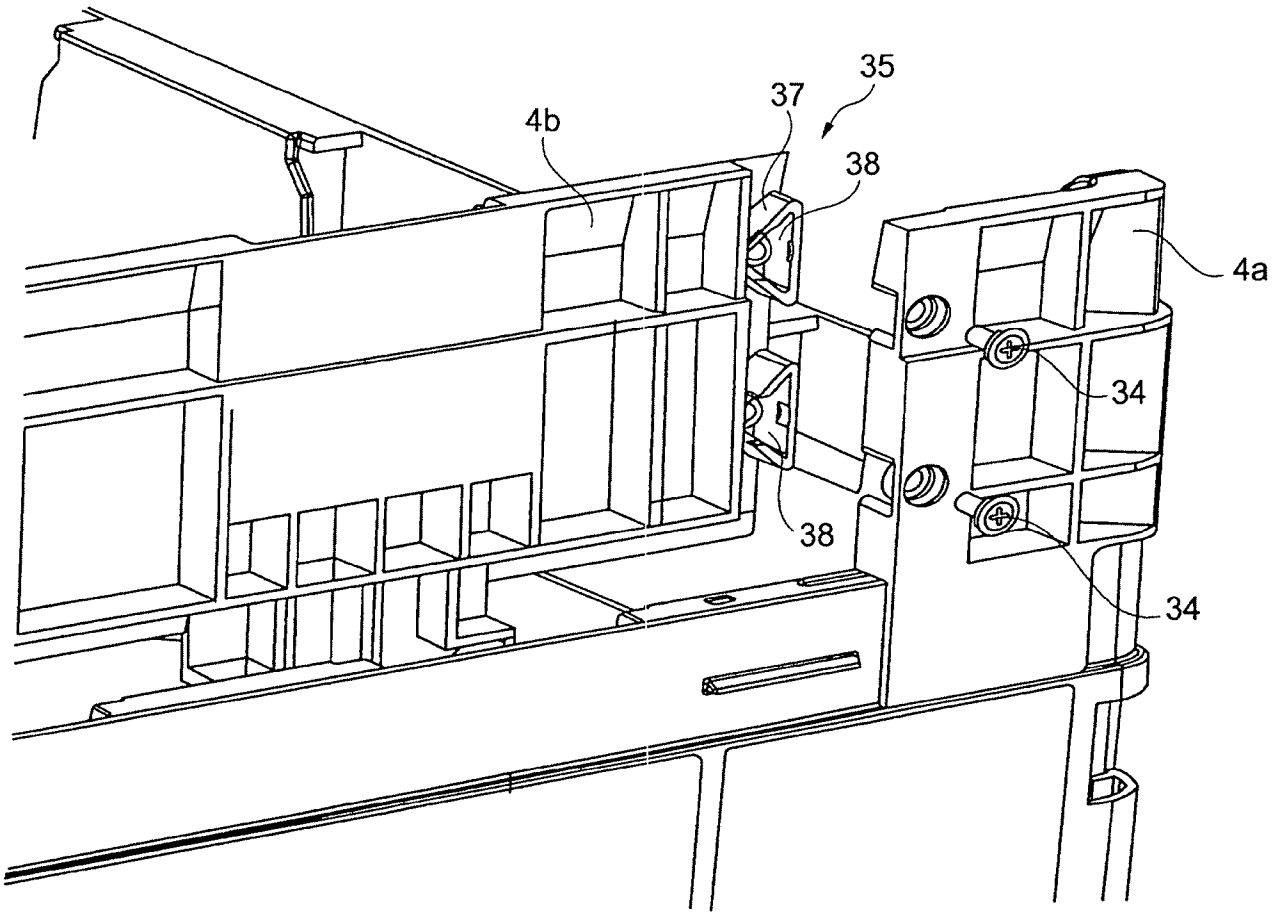
FIG. 8 illustrates a perspective view of two plug in mechanisms of two pedestal elements from an outside of the large cargo carrier.
Figure 9:
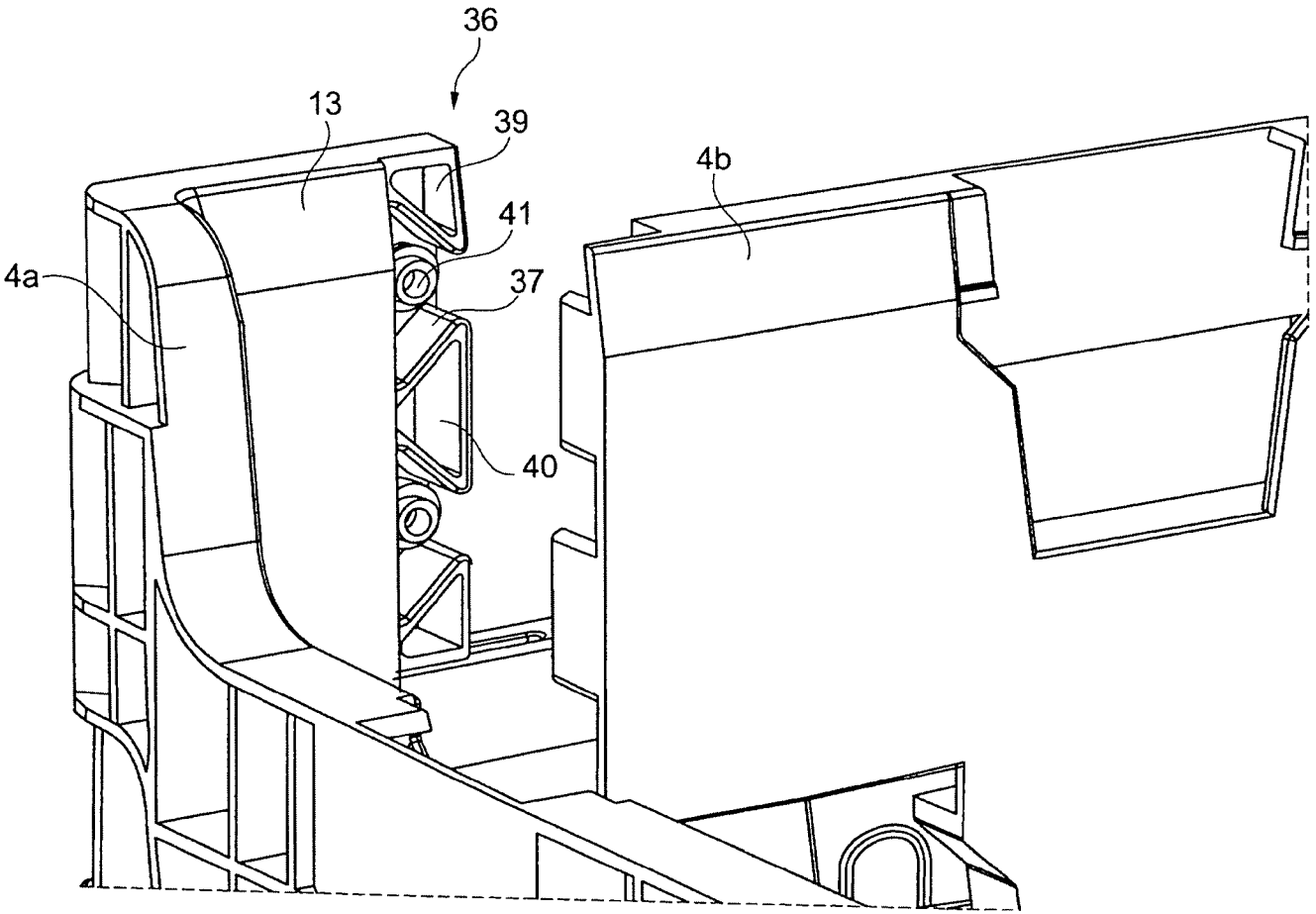
FIG. 9 illustrates a perspective view of two plug in mechanisms of two pedestal elements from an inside of the large cargo carrier.

In FIGS. 8 and 9, the two first and second pedestal elements 4*a*, 4*b* are illustrated from the outside of the large cargo carrier 1 (FIG. 8) or from the inside of the large cargo carrier 1 (FIG. 9). A second pedestal element 4*b* is thus offset in an exploded view into the interior of the large cargo carrier 1 which illustrates the plug in mechanisms 35, 36 of the pedestal elements 4*a*, 4*b* to be joined in a particularly clear manner. The plug in mechanisms 35, 36 of the pedestal elements 4*a*, 4*b* can be assembled like a puzzle in a direction parallel to the base. Thus plural form locking surfaces 37 are provided that are arranged at a slant angle, wherein the form locking surfaces extend parallel to the base over a portion of the U-arm 13 of the first pedestal element 4*a* and over a respective portion of the second pedestal element 4*b*. The form locking surfaces 37 that are arranged at a slant angle thus follow a zigzag support essentially over the entire height of the pedestal elements 4*a*, 4*b*.

In this embodiment, the plug in mechanism 35 of the second pedestal element 4*b* includes a dove tail structure with two trapezes 38. Complementary thereto the plug in mechanism 36 of the first pedestal element 4*a* also includes a dove tail structure, thus a respective triangle 39 on the top side and on the bottom side and a trapeze 40 in the center which respectively form the four form locking surfaces 37. In the plug in mechanisms 35, 36, additional boreholes for bolted connections are arranged for additionally securing the attachment.

What is claimed is:

1. A large cargo carrier (1), comprising: a pallet shaped base element (2) and at least one disengageably attached sidewall (5*a*, *b*), preferably four disengageably attached sidewalls (5*a*, *b*), at least one pedestal element (4*a*, *b*) that is configured so that it is disengageably attachable at the pallet shaped base element (2) and the at least one sidewall (5*a*, *b*) is disengageably attachable at the at least one pedestal element (4*a*, 4*b*) characterized in that, the large cargo carrier (1) includes at least one edge bar (3*a*, *b*) extending over at least one side of the large carrier and arranged on top of the pallet shaped base element (2), and the pedestal element (4*a*, *b*) is disengageably attachable at the at least one edge bar (3*a*, *b*), wherein the at least one edge bar (3*a*, *b*) includes a plug in mechanism on its inside surface in which the plug in mechanism is configured as a plug in groove (9*a*, *b*) which includes protruding shoulders (23), wherein the at least one pedestal element (4*a*, *b*) includes a plug in mechanism at its bottom side in which the plug in mechanism is configured as plug in pinions (8*a*, *b*) insertable into grooves (9*a*, *b*) of the at least one edge bar (3*a*, *b*) or grooves (10*a*, *b*) of the at least one pedestal element (4*a*, *b*), in the grooves (9*a*, *b*) being configured complementary to the plug in pinions (8*a*, *b*) and provided with protruding shoulders, so that the pedestal element (4*a*, 4*b*) is connectable with its edge bar (3*a*, 3*b*) through form locking, wherein the plug in mechanism of the edge bar (3*a*, *b*) is configured complementary with the plug in mechanism of the pedestal element (4*a*, 4*b*), wherein the pedestal element (4*a*, 4*b*) is secured by the protruding shoulders (23) of the plug in groove (9*a*, 9*b*) of the edge bar (3*a*, 3*b*) against being lifted off in upward direction, wherein an additional pedestal element (4*a*, 4*b*) which is applicable to the pedestal element (4*a* , 4*b*) is secured by the protruding shoulder of the plug in groove (9*a*, 9*b*) against being lifted off in upward direction, and wherein the side wall (5*a*, 5*b*) is arrangeable on the edge bar (3*a*, 3*b*) or on the pedestal elements (4*a*, 4*b*).

2. The large cargo carrier (1) according to claim 1, wherein the edge bar (3*a*, 3*b*) is integrally configured in one piece at the base element (2).

3. The large cargo carrier (1) according to claim 1, wherein the large cargo carrier (1) includes four edge bars (3*a*, *b*) arranged at the pallet shaped base element (2) and preferably configured integrally therewith, wherein the edge bars are circumferentially arranged and preferably two respective edge bars (3*a*, *b*) that adjoin one another in an edge portion (11) are configured with different heights and wherein the large cargo carrier (1) includes at least four pedestal elements (4*a*, *b*) which form a circumferential attachment frame (7) with one another.

4. The large cargo carrier (1) according to claim 3, wherein the pedestal elements (4*a*, *b*) include a plug in mechanism (35-40) respectively acting on both sides laterally in a direction parallel to the base and in particular including a trapezoid or triangular structure and pedestal elements (4*a*, *b*) adjoining one another are joinable through the plug in mechanism (35-40) in a form locking manner.

5. The large cargo carrier (1) according to claim 3, wherein two pedestal elements (4*a*) that are arranged opposite one another extend in a U-shape respectively over a preferably shorter side (a) of the large cargo carrier (1) and over corner portions (11) adjacent thereto and adjoining portions of the adjacent sides (b) of the large cargo carrier (1), and the two other pedestal elements (4*b*) that are arranged opposite one another respectively extend over an intermediary portion of a preferably longer side (b) of the large cargo carrier (1).

6. The large cargo carrier (1) according to claim 1, wherein the at least one edge bar (3*a*, 3*b*) includes plug in grooves (9*a*, 9*b*), configured as dove tails and the at least one pedestal element (4*a*, 4*b*) includes plug in pinions (8*a*, 8*b*) which are configured complementary with the plug in grooves (9*a*, 9*b*) and which interact in a form locking manner with the plug in grooves (9*a*, 9*b*).

7. The large cargo carrier (1) according to claim 6, wherein the at least one pedestal element (4*a*, 4*b*) is secured against a lift-off from above through protruding shoulders (23) at the plug in grooves (9*a*, 9*b*).

* * * * *

UNITED STATES PATENT AND TRADEMARK OFFICE

CERTIFICATE OF CORRECTION

PATENT NO. : 8,955,709 B2
APPLICATION NO. : 13/639996
DATED : February 17, 2015
INVENTOR(S) : Reinhard Lorenz et al.

It is certified that error appears in the above-identified patent and that said Letters Patent is hereby corrected as shown below:

In the Specification

At column 6, line 17, delete “41” and insert --9a--.

Signed and Sealed this
Sixteenth Day of June, 2015

Michelle K. Lee

Michelle K. Lee
*Director of the United States Patent and Trademark Office*